US007909436B2

(12) United States Patent
Koseki

(10) Patent No.: US 7,909,436 B2
(45) Date of Patent: Mar. 22, 2011

(54) INKJET HEAD, MANUFACTURING METHOD FOR THE SAME, AND INKJET RECORDING APPARATUS

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 204 days.

(21) Appl. No.: 12/290,153

(22) Filed: Oct. 28, 2008

(65) Prior Publication Data

US 2009/0109263 A1 Apr. 30, 2009

(30) Foreign Application Priority Data

Oct. 31, 2007 (JP) ..... 2007-283010

(51) Int. Cl.
*B41J 2/04* (2006.01)

(52) U.S. Cl. ..... 347/54

(58) Field of Classification Search ..... 347/54, 347/50, 57–59, 61–65, 40, 44, 20
See application file for complete search history.

(56) References Cited

U.S. PATENT DOCUMENTS

| | | | | |
|---|---|---|---|---|
| 5,787,558 | A | 8/1998 | Murphy | 29/25.35 |
| 5,933,169 | A | 8/1999 | Sugahara | 347/71 |

FOREIGN PATENT DOCUMENTS

| | | |
|---|---|---|
| EP | 0364136 | 4/1990 |
| EP | 0734865 | 10/1996 |
| JP | 04173147 | 6/1992 |
| JP | 04259563 | 9/1992 |
| JP | 04347645 | 12/1992 |

*Primary Examiner* — K. Feggins
(74) *Attorney, Agent, or Firm* — Adams & Wilks

(57) ABSTRACT

An inkjet head has a first substrate having first groove portions formed on one surface of the first substrate and an ink supply path connected to the first groove portions and opening toward another surface of the first substrate. A second substrate has second groove portions and is connected to the first substrate so that the first and second groove portions jointly form ink chambers. First drive electrodes are formed on sidewalls of the first groove portions. Second drive electrodes are formed on sidewalls of the second groove portions. Conduction members are formed only adjacent to the ink supply path of the first substrate and electrically connect the respective first and second drive electrodes to one another.

17 Claims, 11 Drawing Sheets

FIG.7A-i
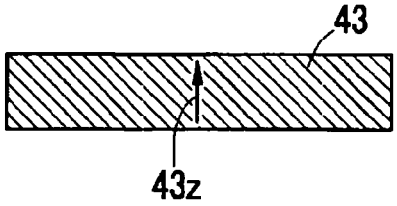
FIG.7A-ii
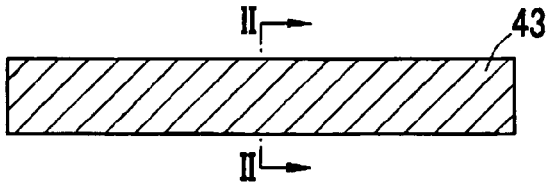
FIG.7B-i
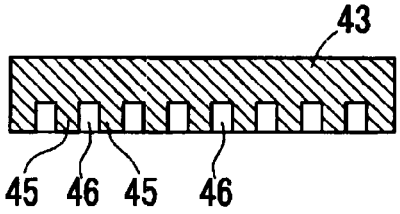
FIG.7B-ii
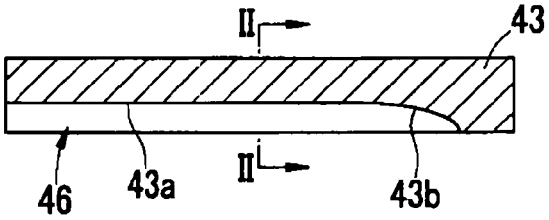
FIG.7C-i
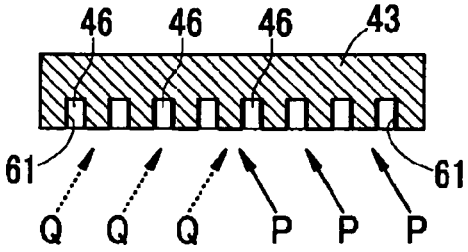
FIG.7C-ii
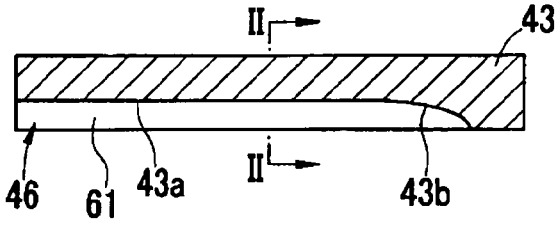
FIG.7D-i
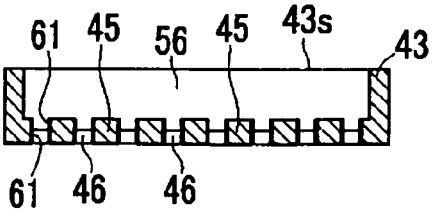
FIG.7D-ii
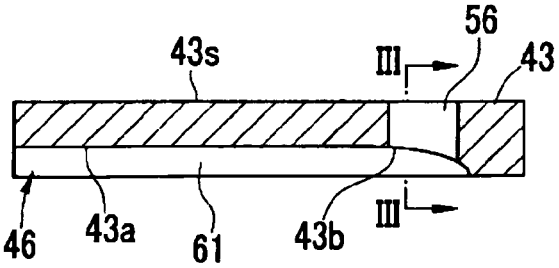

FIG.8A-i
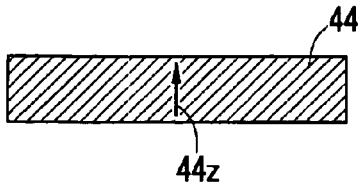
FIG.8A-ii
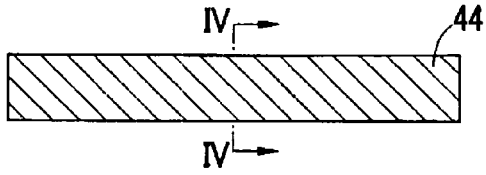
FIG.8B-i
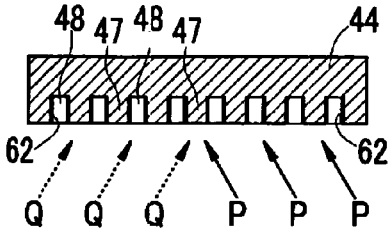
FIG.8B-ii
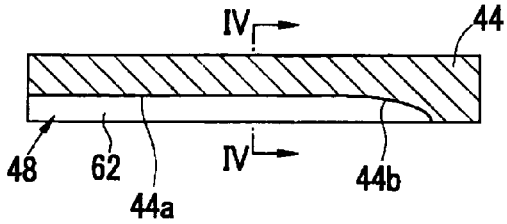
FIG.8C-i
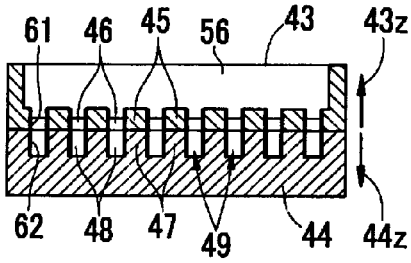
FIG.8C-ii
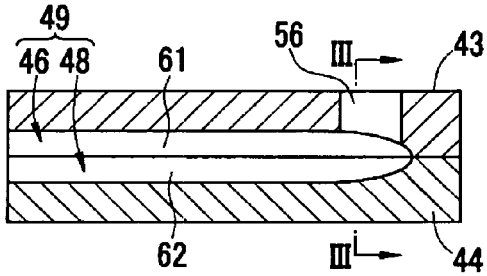
FIG.8D-i
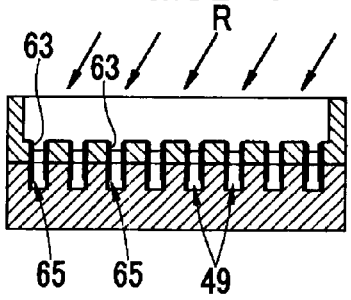
FIG.8D-ii
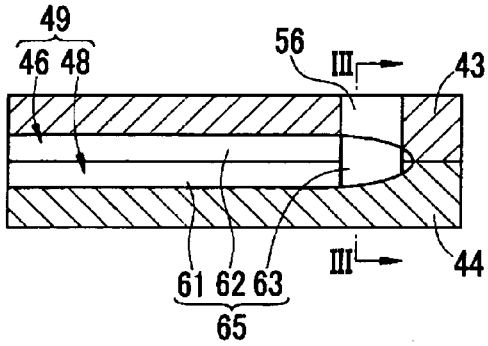
FIG.8E-i
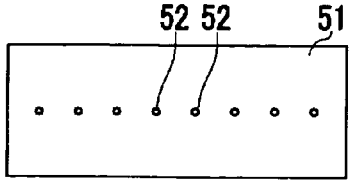
FIG.8E-ii
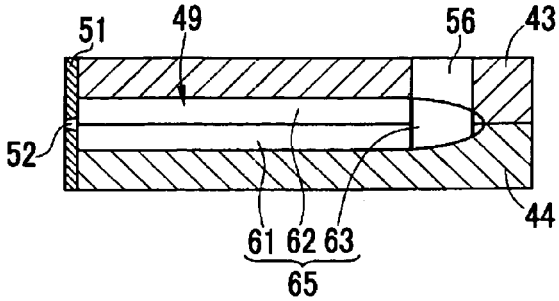

INKJET HEAD, MANUFACTURING METHOD FOR THE SAME, AND INKJET RECORDING APPARATUS

BACKGROUND OF THE INVENTION

1. Field of the Invention

The present invention relates to an inkjet head, a manufacturing method for the same, and an inkjet recording apparatus.

2. Description of the Related Art

There is generally known an inkjet recording apparatus for recording characters or images on a recording medium using an inkjet head including a plurality of nozzles which eject ink (for example, see JP 2004-090492 A and JP 2005-212365 A). In the inkjet head described in JP 2005-212365 A, regions each having a different polarization direction are formed in the poles serving as a driving section of the head, whereby a drive voltage is reduced to realize high efficiency of ejecting operations.

FIG. 11 is a flowchart showing in section a manufacturing method for an inkjet head described in JP 2005-212365 A.

In manufacturing a conventional inkjet head, first, as shown in FIG. 11A, a first piezoelectric substrate 543 and a second piezoelectric substrate 544 each having a different polarization direction are prepared, and those piezoelectric substrates are made to be opposite to each other for bonding. Next, as shown in FIG. 11B, the first piezoelectric substrate 543 having a thickness of about 1 mm is ground so as to have a thickness of about 0.15 mm. Next, as shown in FIG. 11C, a plurality of groove portions 549 are processed from the first piezoelectric substrate 543 side. Next, drive electrodes 565 are film-formed on side walls of the groove portions 549, and then a cover plate substrate 550 having an ink supply path 556 formed therein is bonded to the first piezoelectric substrate 543.

As described above, in the manufacturing method for an inkjet head as shown in FIGS. 11A to 11E, three substrates, that is, the first piezoelectric substrate 543, the second piezoelectric substrate 544, and the cover plate substrate 550, are required. The first piezoelectric substrate 543 is processed thinly to have a thickness of about 1 mm to about 0.15 mm, which leads to an increase in material costs or processing costs. Further, most parts of the first piezoelectric substrate 543 are discarded through grinding, which is a waste of materials.

SUMMARY OF THE INVENTION

The present invention has been made in view of the aforementioned problems, and an object thereof is to provide an inkjet head, which can be manufactured with ease, and a manufacturing method for the same while saving material costs or processing costs.

In order to solve the aforementioned problems, the present invention relates to the inkjet head including: a base substrate, at least a part of the base substrate being formed of a piezoelectric material; a plurality of ink chambers formed in the base substrate; and drive electrodes formed on side walls of the plurality of ink chambers, in which: the base substrate is formed of a first substrate and a second substrate through bonding, at least one of the first substrate and the second substrate being a piezoelectric substrate; the first substrate includes a plurality of first groove portions formed on one surface thereof, and an ink supply path which is connected to the plurality of first groove portions and opens toward another surface thereof; the second substrate includes a plurality of second groove portions, the plurality of second groove portions forming the plurality of ink chambers, on a bonding surface between the first substrate and the second substrate, together with the plurality of first groove portions; and the drive electrodes are formed on at least one of side walls of the plurality of first groove portions and side walls of the plurality of second groove portions, the at least one of side walls of the plurality of first groove portions and side walls of the plurality of second groove portions being the side walls of groove portions of a substrate being the piezoelectric substrate among the first substrate and the second substrate.

With this structure, the inkjet head can be formed using two piezoelectric substrates, or one piezoelectric substrate and one substrate made of another material (for example, alumina substrate), and hence the inkjet head can be manufactured using fewer substrates at a lower cost compared with the conventional inkjet head. Besides, most of the initial substrate is not discarded through polishing, and thus waste of materials does not occur.

Alternatively, a structure in which both of the first substrate and the second substrate are the piezoelectric substrates may be employed. In this case, though manufacturing costs increase because two piezoelectric substrates are used, there can be realized an inkjet head having a structure in which the side wall partitioning the first groove portion and the side wall partitioning the second groove portion are driven (a shear deformation is generated) to discharge ink.

Preferably, a depth of the first groove portion is substantially equal to a depth of the second groove portion. With such a structure, a maximum ink discharge amount can be obtained.

Further, there can be employed a structure in which the second groove portion has a width different from a width of the first groove portion. With such a structure, a margin of positioning the first groove portion and the second groove portion increases, which enhances the manufacturability.

There can be employed a structure in which: the first piezoelectric substrate and the second piezoelectric substrate are each a piezoelectric substrate and have polarization directions opposite to each other in a thickness direction thereof; a first drive electrode is formed on the sidewall of the first groove portion, and a second drive electrode is formed on the side wall of the second groove portion; and the drive electrode includes the first drive electrode, the second drive electrode, and a conduction member connecting the first drive electrode and the second drive electrode. With this structure, all the side walls of the ink chamber deform in response to a voltage application, and thus the inkjet head can be driven at a low voltage, and power consumption thereof can be reduced.

Also with this structure, the width of the second groove portion is preferably larger than the width of the first groove portion. By employing such a structure, a conduction member excellent in reliability can be formed without difficulty, and an inkjet head excellent in reliability can be easily manufactured.

According to the present invention, there is provided a manufacturing method for an inkjet head including a plurality of ink chambers and drive electrodes, the plurality of ink chambers being formed in a base substrate, at least apart of the base substrate being formed of a piezoelectric material, the drive electrodes being formed on side walls of the plurality of ink chambers, the manufacturing method including: preparing a first substrate and a second substrate, at least one of the first substrate and the second substrate being a piezoelectric substrate, and forming a plurality of first groove portions each serving as a part of each of the plurality of ink chambers on one surface of the first substrate to form, on a surface opposite to the surface formed with the plurality of first groove portions, an ink supply path connected to the plurality of first groove portions; forming, on one surface of the second substrate, a plurality of second groove portions forming of the plurality of ink chambers with the plurality of first groove portions; forming the drive electrodes on side walls of any one of the plurality of first groove portions and the plurality of second groove portions, the side walls of any one of the plurality of first groove portions and the plurality of second groove portions being the side walls of groove portions of a substrate being the piezoelectric substrate among the first substrate and the second substrate; and causing the plurality of first groove portions and the plurality of second groove portions to be opposite to each other to bond the first substrate to the second substrate.

According to this manufacturing method, two piezoelectric substrates, or one piezoelectric substrate and one substrate made of another material can be used to manufacture the inkjet head including the ink chamber and the ink supply path, which makes it possible to manufacture the inkjet head at a lower cost compared with a conventional inkjet head.

Preferably, a depth of the plurality of first groove portions is substantially equal to a depth of the plurality of second groove portions. According to this manufacturing method, a high-performance inkjet head can be easily manufactured.

A width of the plurality of second groove portions may be formed differently from a width of the plurality of first groove portions. According to this manufacturing method, because the margin of positioning of the first piezoelectric substrate and the second piezoelectric substrate is increased, and thus the inkjet head can be easily manufactured.

The first piezoelectric substrate and the second piezoelectric substrate may each be the piezoelectric substrate and have polarization directions opposite to each other in a thickness direction thereof, the forming the drive electrodes may include forming first drive electrodes on the side walls of the plurality of the first groove portions and forming second drive electrodes on the side walls of the plurality of second groove portions, and the manufacturing method may further include forming, after bonding the first substrate to the second substrate, a conduction member connecting the first drive electrode and the second drive electrode. With this structure, an inkjet head causing deformation in all the side walls of the ink chamber can be manufactured.

The forming a conduction member preferably includes film-forming the conduction members on the sidewalls of the plurality of first groove portions and the side walls of the plurality of second groove portions via the ink supply path. According to this manufacturing method, the first drive electrode and the second electrode are easily made conductive after bonding the first piezoelectric substrate to the second piezoelectric substrate.

The width of the plurality of second groove portions is preferably formed larger than the width of the plurality of first groove portions. According to this manufacturing method, a conduction electrode can be easily formed without impairing reliability of the conduction electrode.

An inkjet recording apparatus according to the present invention includes the inkjet head according to the present invention. With this structure, the inkjet recording apparatus can be provided at a low cost.

According to the present invention, because the inkjet head can be formed using two piezoelectric substrates, the inkjet head can be provided using fewer substrates at a lower cost compared with a conventional inkjet head. Moreover, the inkjet head according to the present invention can be manufactured without waste of the materials since fewer parts thereof are discarded through grinding. Besides, according to the present invention, the inkjet head can be manufactured at a low cost. Further, the inkjet recording apparatus can be manufactured inexpensively.

BRIEF DESCRIPTION OF THE DRAWINGS

In the accompanying drawings:

FIGS. 7A-*i* to 7D-ii are flowcharts showing a manufacturing process of the inkjet head according to the first embodiment;

FIGS. 8A-*i* to 8E-ii are flowcharts showing another manufacturing process of the inkjet head according to the first embodiment;

DETAILED DESCRIPTION OF THE PREFERRED EMBODIMENTS

First Embodiment

Hereinafter, an inkjet head according to a first embodiment of the present invention and an inkjet recording apparatus provided with the inkjet head are described with reference to the drawings.

Figure 1:
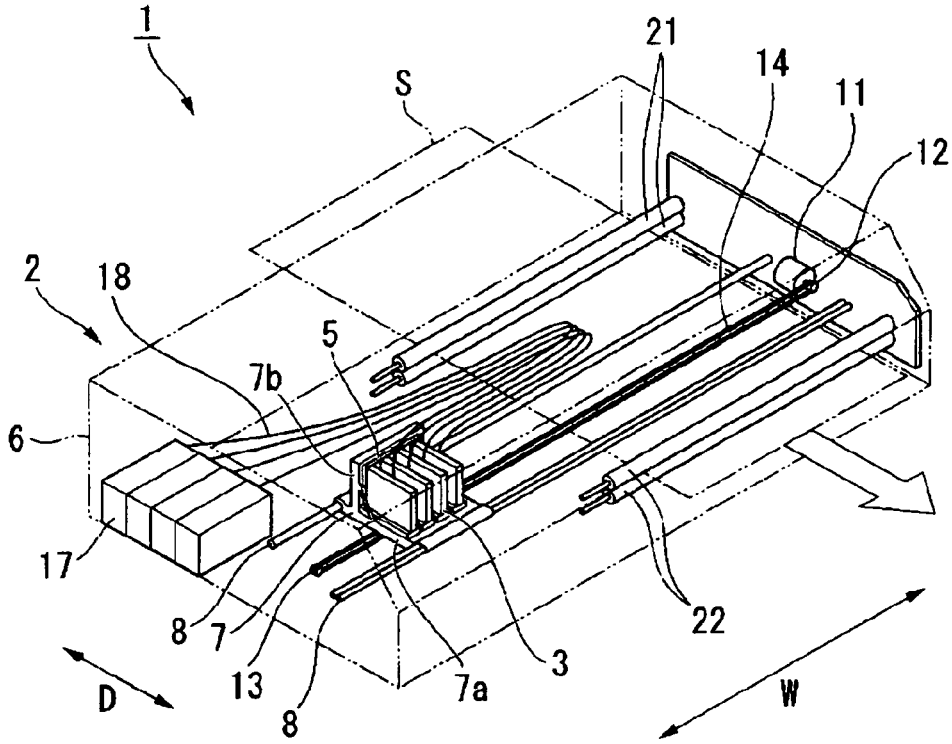
FIG. 1 is a view showing an inkjet recording apparatus according to a first embodiment of the present invention.
Figure 2:
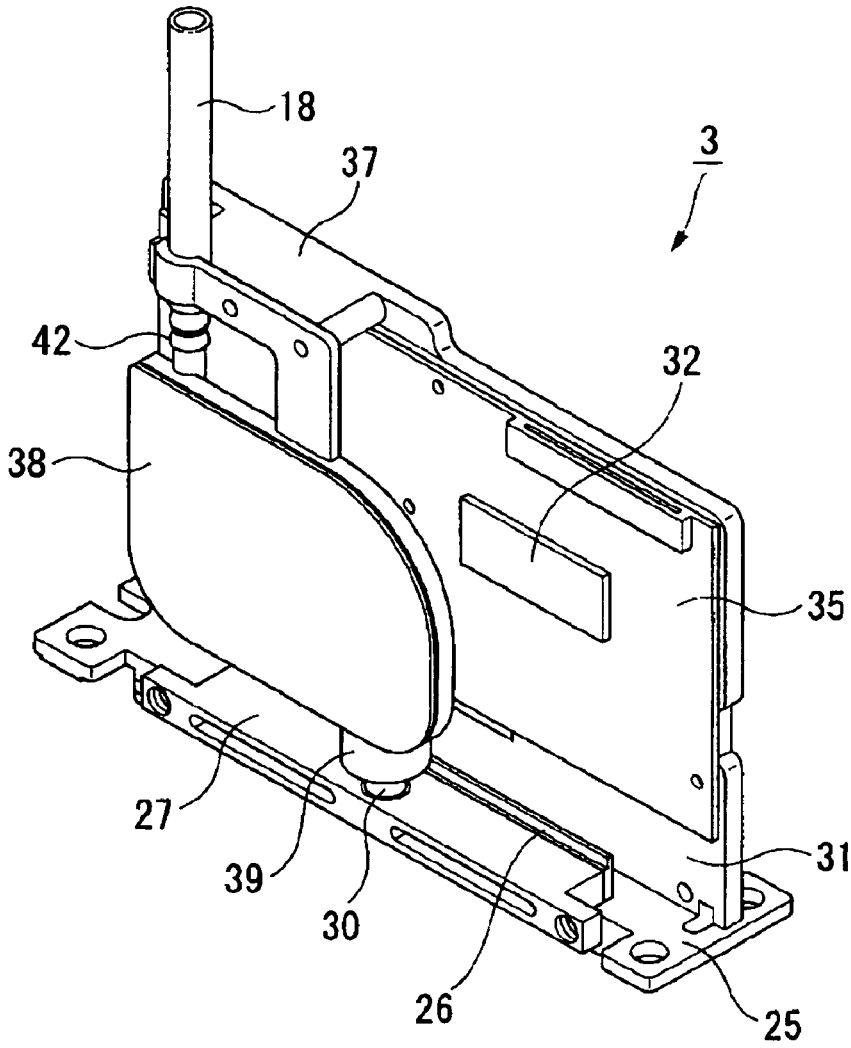
FIG. 2 is a view showing a head unit according to the first embodiment.
Figure 3:
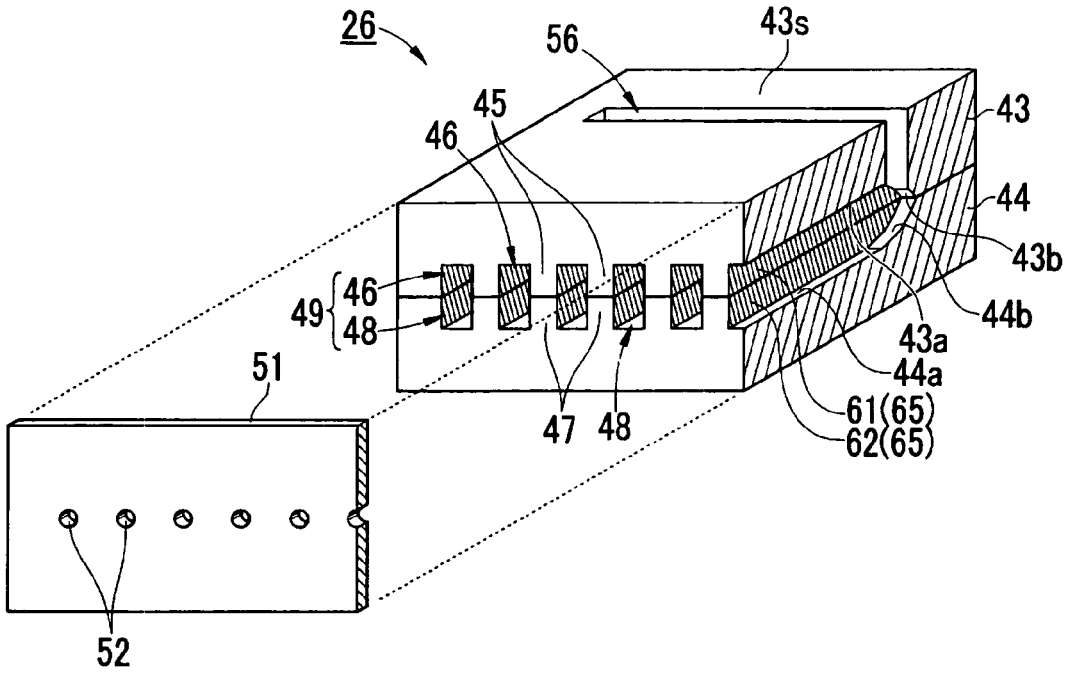
FIG. 3 is a perspective structural view of an inkjet head according to the first embodiment.
Figure 4:
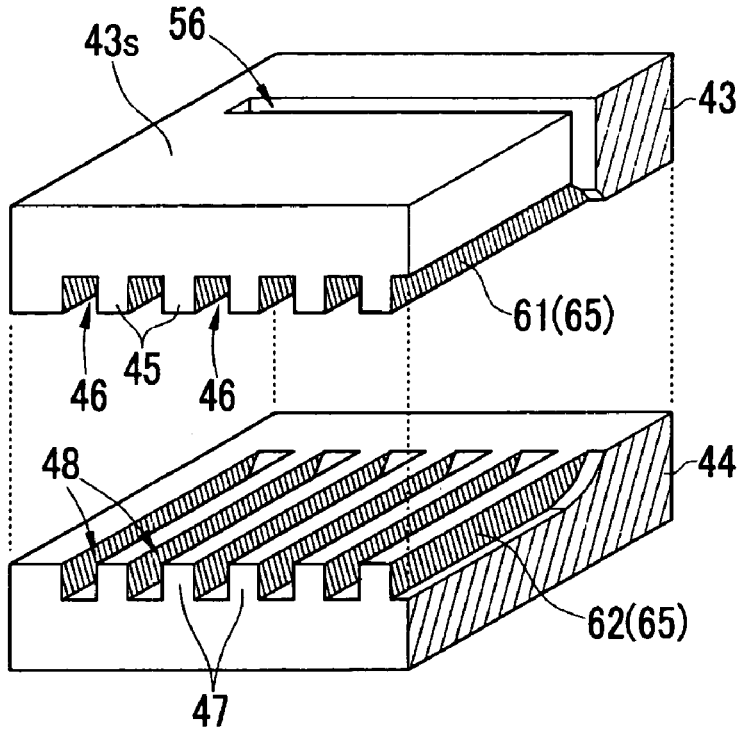
FIG. 4 is an exploded perspective view of the inkjet head according to the first embodiment.

FIG. 1 is a view showing the inkjet recording apparatus according to the first embodiment of the present invention. FIG. 2 is a perspective view showing a head unit provided in the inkjet recording apparatus. FIG. 3 is a perspective view showing an inkjet head according to this embodiment. FIG. 4 is an exploded perspective view of the inkjet head shown in FIG. 3.

An inkjet recording apparatus 1 includes an apparatus main body 2 and a plurality of head units 3 housed in the apparatus main body 2. The apparatus main body 2 includes a casing 6 having a substantially rectangular parallelepiped shape. In the casing 6, there are provided a carriage 7, guide rails 8, an ink cartridge 17, carrying-in rollers 21, and carrying-out rollers 22.

The carriage 7 includes a flat-shaped pedestal 7*a*. The head units 3 are fixed to the pedestal 7*a*. At an edge of the pedestal 7*a*, a pedestal wall portion 7*b* provided to extend upward from the pedestal 7*a* is provided. The pedestal wall portion 7*b* is provided with a wiring board 5. The wiring board 5 is provided with an electronic component for operating each component of the inkjet recording apparatus 1.

The carriage 7 is supported by a pair of guide rails 8 extending in a width direction (longitudinal direction) W of the casing 6. The carriage 7 is made to reciprocate in the width direction W of the casing 6 along the guide rails 8.

A timing belt 14 extending along the guide rails 8 is provided between the pair of guide rails 8. The timing belt 14 is fixed to the carriage 7 and is also made to bridge over pulleys 12 and 13 which are provided at respective ends of the casing 6 in the width direction W thereof. The pulley 12 is coupled to a motor 11, and the carriage 7 is made to reciprocate in the width direction W via the timing belt 14 by driving the motor 11.

The ink cartage 17 is placed in the vicinity of a side surface of the casing 6. Flexible ink supply tubes 18 extend from the ink cartridge 17, and each edge of the ink supply tubes 18 is connected to each of the head units 3 attached to the carriage 7. Through the ink supply tubes 18, various inks are supplied from the ink cartridge 17 to the head units 3.

Further, on a front surface (surface at a right side in a D direction of FIG. 1) and a rear surface (surface at a left side in a D direction of FIG. 1) of the casing 6, apertures (not shown) provided to be opposite to each other are provided. In a position corresponding to the aperture of the front surface among those apertures, the pair of carrying-out rollers 22 extending in the longitudinal direction W are provided. On the other hand, in a position corresponding to the aperture of the rear surface, the pair of carrying-in rollers 21 extending in the longitudinal direction W are provided. When the carrying-in rollers 21 and the carrying-out rollers 22 are driven, a sheet (recording medium) S arranged at the aperture of the rear surface is drawn into the casing 6 and is subjected to a process, and the sheet S subjected to the recording process is delivered from the aperture of the front surface.

As shown in FIG. 2, the head unit 3 includes a mounting base 25, an inkjet head 26, a flow channel substrate 27, a pressure adjustment portion 38, a base plate 31, and a wiring board 35 onto which a control circuit 32 is mounted.

At a lower edge of the head unit 3, the mounting base 25 having a substantially rectangular shape is arranged. The mounting base 25 is attached to the pedestal 7*a* of the carriage 7 via screws (not shown). The inkjet head 26 is attached to a top surface of the mounting base 25. At one surface side of the inkjet head 26, the flow channel substrate 27, which extends over a full length in a longitudinal direction thereof and has a rectangular shape, is provided. A coupling portion 30 is provided in a center of a top surface of the flow channel substrate 27.

The pressure adjustment portion 38 including a reservoir for reserving ink is provided above the flow channel substrate 27. An ink communicating pipe 39 communicating with the reservoir is provided below the pressure adjustment portion 38. The ink communicating pipe 39 is coupled to the coupling portion 30 of the flow channel substrate 27 via an O-ring.

On the other hand, above the pressure adjustment portion 38, an ink intake 42 communicating with the reservoir is provided. The ink supply tube 18 is attached to the ink intake 42.

Besides, the base plate 31 which is erected from the mounting base 25 and has a rectangular shape is provided to the mounting base 25. The base plate 31 is a plate-like material made of aluminum or the like. On one of principal surfaces (principal surface at the inkjet head 26 side) of the base plate 31, the wiring board 35 is provided. The control circuit 32 which performs various types of control for the inkjet head 26 is mounted onto the wiring board 35. A supporting portion 37 extending to one principal surface side is provided on an upper edge of the base plate 31. Through fixation of the pressure adjustment portion 38 to the supporting portion 37, the head unit incorporating the aforementioned respective members is formed.

In the head unit 3 of the aforementioned structure, ink supplied from the ink cartridge 17 via the ink supply tubes 18 is taken from the ink intake 42 to the reservoir within the pressure adjustment portion 38. Then, a predetermined amount of ink is supplied to the inkjet head 26 via the ink communicating pipe 39 and the flow channel substrate 27.

As shown in FIG. 3 and FIG. 4, the inkjet head 26 includes a substrate formed of a first piezoelectric substrate 43 and a second piezoelectric substrate 44 which are placed to be opposite to each other and have a substantially rectangular shape, and has a structure in which a nozzle plate 51 is bonded to a side edge surface of the substrate.

The first piezoelectric substrate 43 is formed of, for example, lead zirconium titanate (PZT). On a lower surface (surface on the second piezoelectric substrate 44 side) of the first piezoelectric substrate 43, which is shown in FIG. 3, a plurality of first groove portions 46 extending in a short side direction of the first piezoelectric substrate 43 are formed in a stripe shape. In other words, the plurality of first groove portions 46 are partitioned from each other by side walls 45 formed therebetween.

A bottom surface of the first groove portion 46 is formed of a front planar surface 43*a* extending from a front side of the first piezoelectric substrate 43 to a substantially center portion in the short side direction thereof and an inclined surface 43*b* which is formed such that a depth thereof gradually decreases from a rear portion of the front planar surface 43*a* toward a rear side of the first piezoelectric substrate 43. First drive electrodes 61 are formed on side wall surfaces of the first groove portion 46.

The first piezoelectric substrate 43 is formed with an ink supply path 56 opening toward a principal surface 43*s* opposite to the first groove portion 46. The ink supply path 56 is an aperture which extends along a longitudinal direction of the first piezoelectric substrate 43 and has a rectangular shape. The ink supply path 56 pierces the first piezoelectric substrate 43 to reach the first groove portions 46. In other words, the ink supply path 56 opens on the bottom surface of each of the first groove portions 46.

The second piezoelectric substrate 44 is formed of PZT or the like as in the case of the first piezoelectric substrate 43. On an upper surface of the second piezoelectric substrate 44, which is shown in FIG. 3, a plurality of second groove portions 48 extending in a short side direction of the second piezoelectric substrate 44 are formed. Those second groove portions 48 are partitioned from each other by side walls 47.

A bottom surface of the second groove portion 48 is formed of a front planar surface 44*a* and an inclined surface 44*b* as in the case of the bottom surface of the first groove portion 46. Second drive electrodes 62 are formed on side wall surfaces of the second groove portion 48.

The first piezoelectric substrate 43 and the second piezoelectric substrate 44 described above are bonded to each other via an adhesive (not shown) in the state where the first groove portions 46 and the second groove portions 48 are positioned. In other words, the side walls 45 partitioning the first groove portions 46 and the side walls 47 partitioning the second groove portions 48 are bonded to each other on top surfaces thereof. Accordingly, an ink chamber 49 formed of the first groove portion 46 and the second groove portion 48 is formed. The ink supply path 56 is connected to each ink chamber 49.

Figure 5A:
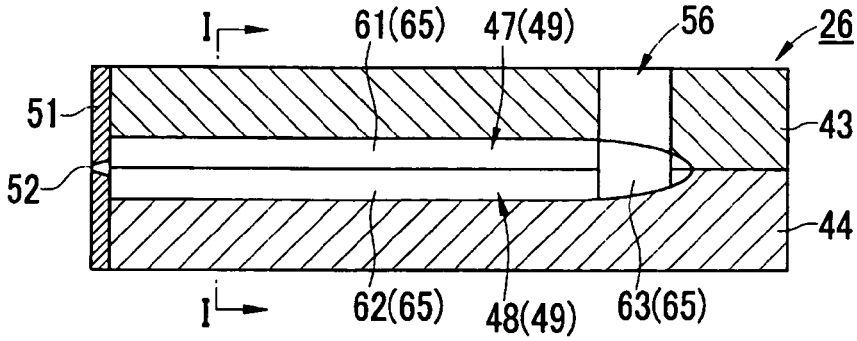
FIGS. 5A and 5B are sectional views of the inkjet head according to the first embodiment.
Figure 5B:
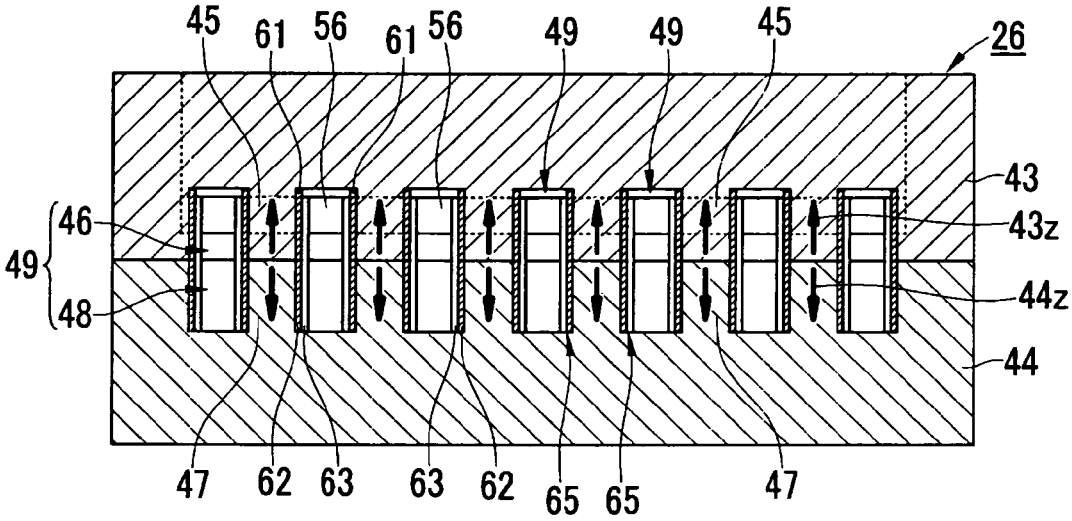

Here, FIG. 5A is a sectional view showing a structure of the ink chamber of the inkjet head, and FIG. 5B is a sectional view taken along a line I-I of FIG. 5A. As shown in FIGS. 5A and 5B, the ink supply path 56 piercing the first piezoelectric substrate 43 leads to the ink chamber 49. In regions extending from the ink supply path 56 in a thickness direction thereof among the side wall surfaces of the ink chamber 49, conduction electrodes (conduction members) 63 are formed. The conduction electrode 63 is formed through the first drive electrode 61 formed on the side wall surface of the first groove portion 46 and the second drive electrode 62 formed on the side wall surface of the second groove portion 48. The first drive electrode 61, the second drive electrode 62, and the conduction electrode 63 form a drive electrode 65 of the inkjet head according to this embodiment.

Note that, though not shown, a terminal of the drive electrode 65 formed on both side walls of the ink chamber 49 is drawn outside the ink chamber 49 through a drawing wire formed simultaneously with the first drive electrode 61 or the second drive electrode 62. The drive electrode 65 is electrically connected to the control circuit 32 via the aforementioned terminal.

Arrows 43*z* and 44*z*, which are added to the side walls 45 and 47 of FIG. 5B, respectively, indicate a polarization direction of the first piezoelectric substrate 43 and a polarization direction of the second piezoelectric substrate 44, respectively. In other words, the first and second piezoelectric substrates are formed of piezoelectric materials having a polarization direction opposite to each other in a thickness direction thereof.

A depth of the first groove portion 46 and a depth of the second groove portion 48, which form the ink chamber 49, are formed to be substantially the same. With such a structure, a displacement amount of a bonding surface between the side wall 45 and the side wall 47 can be made to be maximum, and thus a maximum ink discharge amount can be obtained.

As shown in FIG. 3 and FIG. 5A, on a side edge surface of the substrate formed of the first piezoelectric substrate 43 and the second piezoelectric substrate 44 through bonding, the nozzle plate 51 formed of, for example, polyimide is provided. On one principal surface of the nozzle plate 51 is made a bonding surface between the first piezoelectric substrate 43 and the second piezoelectric substrate 44. On another principal surface (outer surface) of the nozzle plate 51, a water-repellent film (not shown) having water repellency for preventing adhesion of ink or the like is applied.

The nozzle plate 51 is formed with a plurality of nozzle apertures 52 at predetermined intervals (at intervals similar to pitches between the ink chambers 49) in a longitudinal direction thereof. The nozzle apertures 52 are formed in the nozzle plate 51 made of a polyimide film using, for example, an excimier laser. Each of the nozzle apertures 52 is arranged correspondingly to each of the ink chambers 49.

With such a structure, when a predetermined amount of ink is supplied to the flow channel substrate 27 from the reservoir chamber within the pressure adjustment portion 38 via the ink communicating pipe 39 and the coupling portion 30, the supplied ink is fed to the respective ink chambers 49 via the ink supply path 56. Then, the inkjet head 26 vibrates the side walls 45 and 47 to change volumes of the ink chambers 49, with the result that the ink is discharged from the nozzle apertures 52.

Figure 6A:
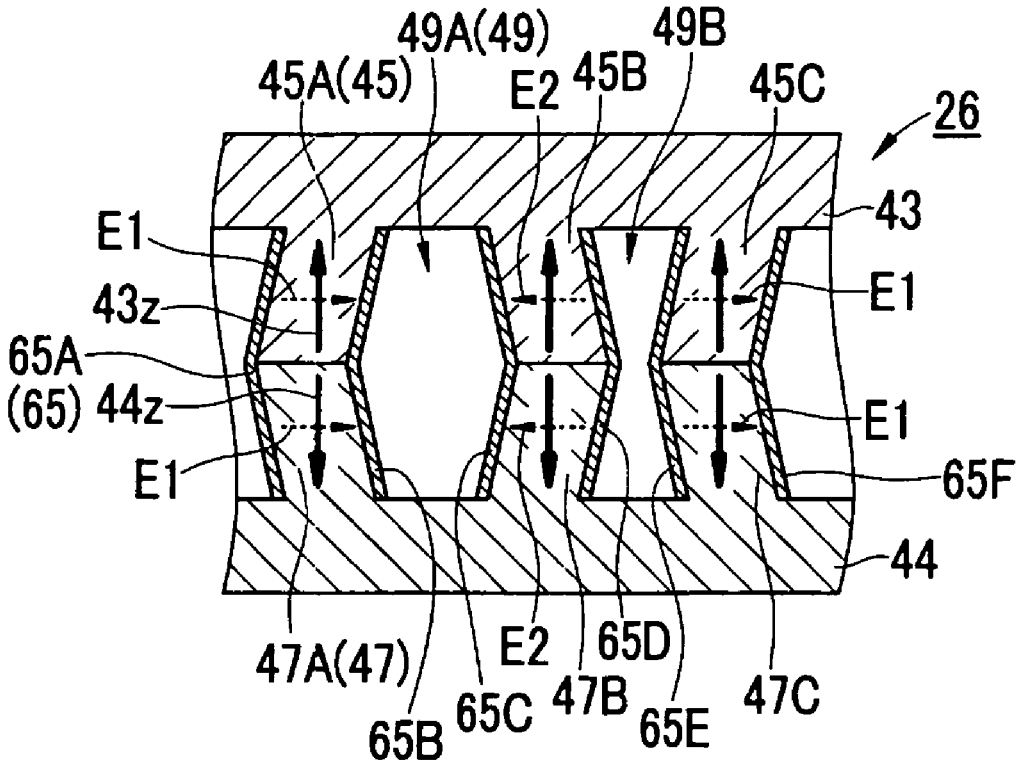
FIGS. 6A and 6B are views explaining operations of the inkjet head according to the first embodiment.
Figure 6B:
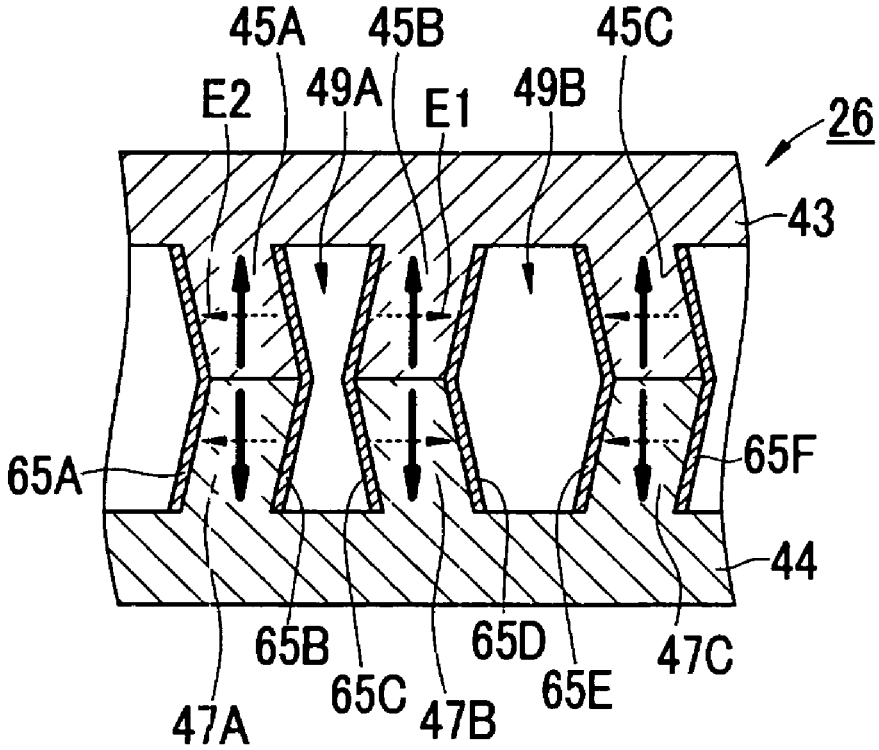

FIGS. 6A and 6B are operation explanatory views of the inkjet head 26. Note that, in FIGS. 6A and 6B, symbols A to F are merely added as reference numerals for distinguishing each structural element.

First, when no voltage is applied to any of the drive electrodes 65, the side walls 45 and 47 of the inkjet head 26 are in upright positions in a substrate thickness direction as shown in FIG. 5B.

Next, as shown in FIG. 6A, voltage is applied to each of drive electrodes 65A and 65B opposing to each other by sandwiching side walls 45A and 47A, drive electrodes 65C and 65D opposing to each other by sandwiching side walls 45B and 47B, and drive electrodes 65E and 67F opposing to each other by sandwiching side walls 45C and 47C, and thus electric fields in electric field directions E1 and E2, which are indicated by chain line arrows, are made to act on piezoelectric materials forming the side walls 45 and 47. The electric field directions E1 and E2 each are orthogonal to polarization directions 43*z* and 44*z*.

Accordingly, a shear deformation is generated on a bonding surface of the side walls 45A and 47A, and in the same manner, the side walls 45B and 47B, and the side walls 45C and 47C are deformed such that bonding surfaces thereof are shifted in directions opposite to the electric field directions E1 and E2, respectively. As a result, a volume of an ink chamber 49A enclosed by the side walls 45A and 47A and the side walls 45B and 47B is increased, whereas a volume of an ink chamber 49B adjacent to the ink chamber 49A is reduced. Then, ink is fed from the ink supply path 56 to the ink chamber 49A whose volume is increased.

Next, when voltage supply to the drive voltages 65 is stopped, the side walls 45 and 47 return to the upright positions shown in FIG. 5B. Then, as shown in FIG. 6A, when voltage applied to the drive electrodes 65 is changed to reverse the electric field directions acting on the side walls 45 and 47, the volume of the ink chamber 49A holding ink is reduced. As a result, the ink is discharged from the nozzle aperture 52 corresponding to the ink chamber 49A. Along with the discharge of the ink, the ink is fed to the ink chamber 49B whose volume is increased.

Further, through repetition of the aforementioned operation, ink is succeedingly discharged from the ink chambers 49A and 49B via the nozzle apertures 52.

According to this embodiment described above, the inkjet head provided with the ink chambers 49 and the ink supply path 56 is realized using two piezoelectric substrates. Therefore, an amount of the substrate usage is reduced compared with a conventional inkjet head, and there is no waste of materials through grinding of the piezoelectric substrate, which leads to an inkjet head excellent in manufacturability.

Besides, the inkjet recording apparatus according to this embodiment includes the inkjet head described above according to the present invention, which realizes the inkjet recording apparatus whose main parts can be manufactured at low costs and which can be provided at a low price.

(Manufacturing Method)

Next, a manufacturing method for the inkjet head 26 according to the first embodiment is described with reference to FIGS. 7A-*i* to 7D-ii and FIGS. 8A-*i* to 8E-ii. Note that, in FIGS. 7A-*i* to 7D-ii and FIGS. 8A-*i* to 8E-ii, FIGS. i and ii are drawings corresponding to each other in the same step. More specifically, FIG. i are sectional views corresponding to positions (positions along lines II-II, III-III, and IV-IV) shown in FIG. ii. FIG. ii are sectional views corresponding to positions where the ink chambers are formed in FIG. i.

First, a processing step of the first piezoelectric substrate 43 is described with reference to FIG. 7A-*i* to 7D-ii.

As shown in FIGS. 7A-*i* and 7A-ii, the first piezoelectric substrate 43 is prepared. As the first piezoelectric substrate 43, a PZT substrate having an upward polarization direction 43*z* as shown in FIG. 7A-*i*.

Next, as shown in FIGS. 7B-*i* and 7B-ii, the plurality of first groove portions 46 are formed all over the first piezoelectric substrate 43 (on a bottom surface of FIGS. 7A-*i* and 7A-ii). In processing the first groove portions 46, there can be preferably adopted a dicing process which is performed using a dicing blade having a thickness corresponding to a width of the first groove portion 46. In the case where a disc-shaped dicing blade is used, the inclined surface 43*b* is formed at a back end of the first groove portion 46.

A processing depth of the first groove portion 46 is assumed to be equal to a depth corresponding to substantially a half of a desired height of the ink chamber 49.

Next, as shown in FIGS. 7C-*i* and 7C-ii, a metal material is obliquely vapor-deposited from a side of the first piezoelectric substrate 43 where the first groove portions 46 are formed. Thus, first drive electrodes 61 are formed on the side wall surfaces of the first groove portions 46. Note that the first drive electrodes 61 need to be individually formed on the side wall surfaces of the first groove portions 46 at both sides thereof in a width direction, and thus vapor deposition is performed in a direction P shown in FIG. 7C-*i*, and then vapor deposition is performed in a direction Q opposite to the direction P.

Next, as shown in FIGS. 7D-*i* and 7D-ii, the first piezoelectric substrate 43 is processed from a surface on an opposite side to the first groove portion 46 of the first piezoelectric substrate 43, to thereby form the ink supply path 56. The formed ink supply path 56 passes from the principal surface 43*s* of the first piezoelectric substrate 43 to the inclined surface 43*b* of the first groove portion 46 to open toward a bottom surface of the first groove portion 46.

Through the steps described above, the first piezoelectric substrate 43 formed with the first groove portions 46 and the ink supply path 56 is obtained. Next, a processing step of the second piezoelectric substrate 44, which is performed separately from the processing step of the first piezoelectric substrate 43, is described with reference to FIGS. 8D-*i* and 8E-ii.

First, as shown in FIGS. 8A-*i* and 8A-ii, the second piezoelectric substrate 44 is prepared. As the second piezoelectric substrate 44, the PZT substrate having an upward polarization direction 44*z* as shown in FIG. 8A-*i* is used.

Next, as shown in FIGS. 8B-*i* and 8B-ii, the plurality of second groove portions 48 are formed all over a surface (bottom surface of FIGS. 8B-*i* and 8B-ii) of the second piezoelectric substrate 44. The dicing process can be preferably used in the process of the second groove portions 48 as in the case of the first groove portions 46. Through this step, the second groove portions 48 including inclined surfaces 44*b* at back sides of the bottom surface thereof are formed. A processing depth of the second groove portions 48 is also substantially a half of the height of the ink chambers 49 to be formed, and is made to be substantially equal to the depth of the first groove portions 46. In addition, a length of the second groove portions 48 is substantially equal to a length of the first groove portions 46.

Next, as shown in FIGS. 8B-*i* and 8B-ii, a metal material is obliquely vapor-deposited from a side of the second piezoelectric substrate 44 where the second groove portions 48 are formed. Thus, the second drive electrodes 62 are formed on side wall surfaces of the second groove portions 48. Note that the second drive electrodes 62 are individually formed on the side wall surfaces of the second groove portions 48 at both sides thereof in a width direction as in the case of the first drive electrodes 61.

Through the steps described above, the second piezoelectric substrate 44 including the second groove portions 48 is obtained.

After the completion of the processing of the first piezoelectric substrate 43 and the second piezoelectric substrate 44, as shown in FIGS. 8C-*i* and 8C-ii, the first piezoelectric substrate 43 and the second piezoelectric substrate 44 are next bonded to each other. At this time, the first groove portions 46 and the second groove portions 48 are aligned for bonding the substrates. In other words, the first piezoelectric substrate 43 and the second piezoelectric substrate 44 are bonded to each other in the state where top surfaces of the side walls 45 (which correspond to bottom surfaces in FIG. 8C-*i*) partitioning the first groove portions 46 and top surfaces of side walls 47 partitioning the second groove portions 48 are aligned. As a result, the ink chambers 49 each formed of the first groove portion 46 and the second groove portion 48 are formed.

Next, as shown in FIGS. 8D-*i* and 8D-ii, a metal film is vapor-deposited from the ink supply path 56 of the first piezoelectric substrate 43 toward the ink chambers 49. Accordingly, conduction electrodes 63 are formed on side walls of the ink chambers 49, whereby the first drive electrode 61 is electrically connected with the second drive electrode 62. The ink chambers 49 each include the drive electrodes 65 formed of the first drive electrode 61, the second drive electrode 62, and the conduction electrode 63 on the side wall surfaces at both sides thereof.

Next, as shown in FIGS. 8E-*i* and 8E-ii, the nozzle plate 51 is bonded to a side edge surface where the apertures of the ink chambers 49 are provided while positioning the nozzle apertures 52 and the ink chambers 49, with the result that the inkjet head according to the first embodiment is obtained.

In the manufacturing method for an inkjet head described above in detail, the first piezoelectric substrate 43 and the second piezoelectric substrate 44 are formed with the first groove portions and the second groove portions 48 which have substantially the same depths, respectively, and the first piezoelectric substrate and the second piezoelectric substrate 44 are bonded to each other, whereby the ink chambers 49 are formed. The first piezoelectric substrate 43 is formed with the ink supply path 56 connected to the plurality of ink chambers 49.

Therefore, according to the manufacturing method of this embodiment, a manufacturing process for the inkjet head, in which three substrates are conventionally required, can be realized using two piezoelectric substrates. Thus, the number of substrates is reduced, which leads to a reduction in cost. Moreover, there is no need to make the piezoelectric substrates thinner through grinding, and hence there is no waste of piezoelectric materials.

In this embodiment, because the depths of the first groove portions 46 are made substantially equal to the depths of the second groove portions 48, the heights of the side walls 45 and 47 which become the side walls of the ink chambers 49 are substantially equal to each other, and a displacement amount of the side walls when the head is driven is maximized. As a result, a maximum ink discharge amount can be obtained.

Note that, in the conventional inkjet head, in order to align the heights of the side walls of portions where the polarization directions are different from each other, adjustment needs to be made in both the formation depths of the grooves and the grinding thicknesses of the piezoelectric substrates. In contrast, in this embodiment, because the side walls 45 and 47 are formed through processing the groove portions, the heights thereof can be easily aligned with each other, and thus the inkjet head can be manufactured with a good yield.

Further, because the conduction electrode 63 electrically connecting the first drive electrode 61 and the second drive electrode 62 is formed by a vapor deposition method performed via the ink supply path 56, even after the first drive electrode 61 and the second drive electrode 62 are formed on separate substrates and the separate substrates are bonded to each other, both the first drive electrode 61 and the second drive electrode 62 are electrically continuous with each other without difficulty.

Note that, in the first embodiment, formation positions and a formation method of the conduction electrodes 63 are not limited to the embodiment described above. In other words, if the first drive electrode 61 can be electrically connected to the second drive electrode 62, the conduction electrode 63 can be formed at appropriate positions by an appropriate method.

For instance, the conduction electrode 63 may be formed by a plating method. For example, in this case, electric field plating in which both of the first drive electrode 61 and the second drive electrode 62 are electrodes is performed. A plated film formed on the first drive electrode 61 and a plated film formed on the second drive electrode 62 are integrated with each other during the growth process of the plated films, whereby the first drive electrode 61 and the second drive electrode 62 can be well conductively connected.

Alternatively, after bonding of the first piezoelectric substrate 43 and the second piezoelectric substrate 44, a conducting film may be obliquely vapor-deposited from an entrance side of the ink chamber 49 opening toward a side edge surface where the nozzle plate 51 is provided.

Further alternatively, a wire pulled out from the first drive electrode 61 may be formed outside the first groove portion 46 when the first drive electrode 61 is formed, and a wire may also be pulled outside the second groove portion 48 when the second drive electrode 62 is formed so that those wires (or terminals formed at tips thereof) are electrically connected to each other outside the ink chamber 49. In the case where the wires are connected to each other as described above, a conductive paste may be used.

(Modification)

Next, a modification of the inkjet head according to the first embodiment is described with reference to FIGS. 9A and 9B.

Figure 9A:
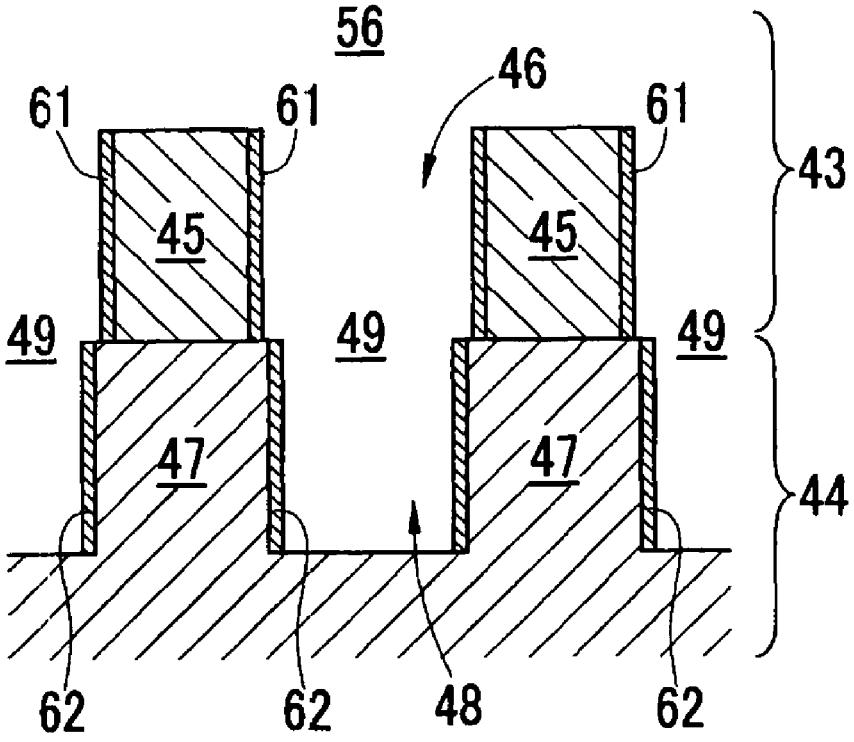
FIGS. 9A and 9B are views showing modifications of the inkjet head according to the first embodiment.
Figure 9B:
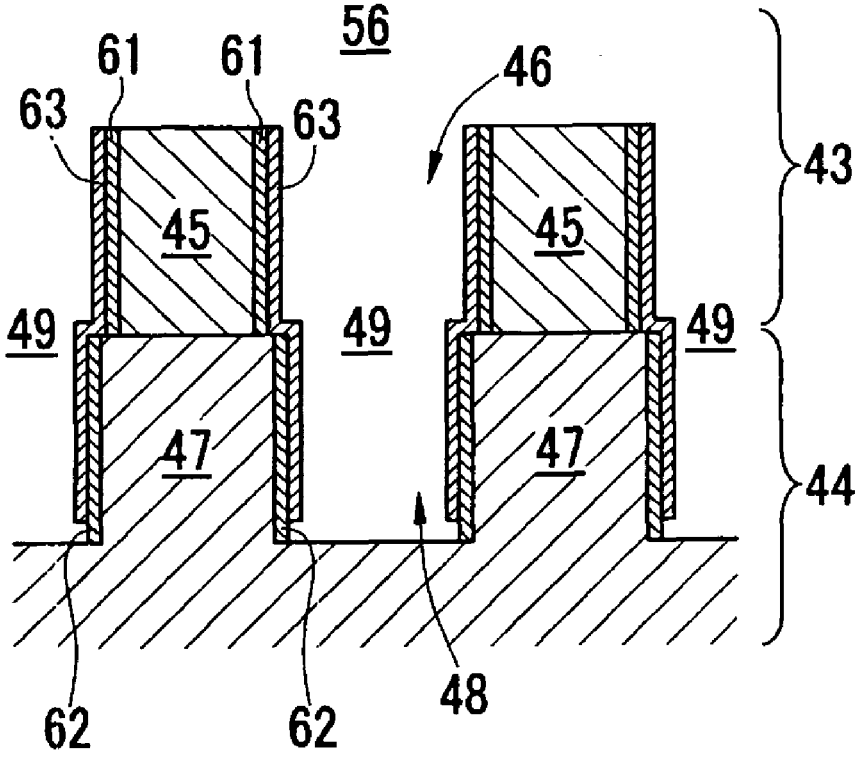

FIG. 9A is an enlarged view showing a vicinity of an ink chamber 49 of the inkjet head according to the modification.

As shown in FIG. 9A, the inkjet head according to this modification is different from the inkjet head according to the first embodiment in the width of the side wall 45 of the first piezoelectric substrate 43 and the width of the side wall 47 of the second piezoelectric substrate 44.

As described above, in the manufacturing method according to the present invention, the first piezoelectric substrate 43 formed with the side walls 45 and the second piezoelectric substrate 44 formed with the side walls 47 are bonded to each other while being adjusted so that the side walls 45 are opposite to the side walls 47. In this case, if the side wall 45 and the side wall 47 are formed to have a different width, the side wall 45 and the side wall 47 can be reliably bonded to each other even if a position of the side wall 45 and a position of the side wall 47 are misaligned in width directions thereof to some extent.

Therefore, adopting the structure of this modification enables a margin of the positioning to increase in the case of bonding the first piezoelectric substrate 43 and the second piezoelectric substrate 44 to each other, while also realizing a simpler manufacturing and enhancement of yield.

Note that, in an example shown FIG. 9A, the width of the side wall 45 is made to be smaller than the width of the side wall 47, but the width of the side wall 47 may be made to be smaller than the width of the side wall 45. With any of those structures, the similar effects can be obtained.

However, in the inkjet head according to the modification, more advantages can be obtained when the width of the side wall 45 of the first piezoelectric substrate 43 is made to be smaller than the width of the side wall 47. FIG. 9B is a view for explaining such advantages. In FIG. 9B, the conduction electrode 63 for electrically connecting the first drive electrode 61 and the second drive electrode 62 is formed.

As described in the former embodiment, the conduction electrode 63 is film-formed through vapor deposition via the ink supply path 56 of the first piezoelectric substrate 43. In the case of forming the conduction electrode 63 in this way, if the width of the side wall 45 is made to be smaller than the width of the side wall 47, a step is formed between the side wall 45 and the side wall 47 as shown in FIG. 9B. Further, because the step faces the ink supply path 56, when vapor deposition is performed from the ink supply path 56 side, the conduction electrode 63 is formed along the step. Accordingly, the first drive electrode 61 and the second drive electrode 62 are satisfactorily brought into conduction by means of the conduction electrode 63.

In contrast, when the width of the side wall 45 is formed to be larger than the width of the side wall 47, the step between the side wall 45 and the side wall 47 becomes a step facing a bottom surface of the second groove portion 48. Thus, even if vapor deposition is performed from the ink supply path side 56, a break is likely to occur in conduction electrode 63.

Therefore, in the case of forming the conduction electrode 63 by vapor deposition from the ink supply path side 56, when the width of the side wall 45 is made to be smaller than the width of the side wall 47, the effect of easily positioning the first piezoelectric substrate 43 and the second piezoelectric substrate 44 can be obtained without impairing the reliability of the conduction electrode 63.

Second Embodiment

Next, a second embodiment of the present invention is described with reference to FIG. 10.

Figure 10:
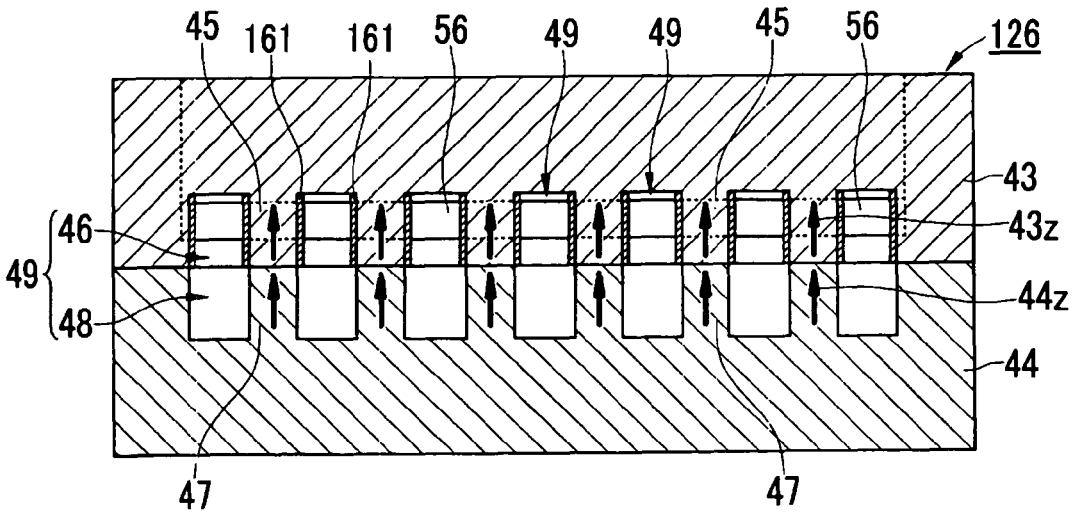
FIG. 10 is a sectional view showing an inkjet head according to a second embodiment of the present invention.
Figure 11A:
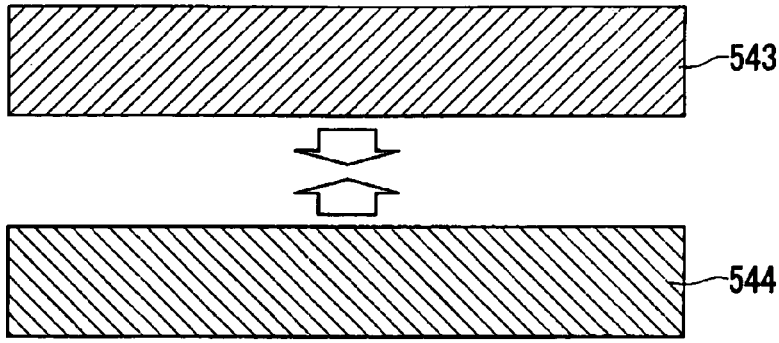
FIG.11A Prior Art
FIGS. 11A to 11E are flowcharts showing a manufacturing process of a conventional inkjet head.
Figure 11B:
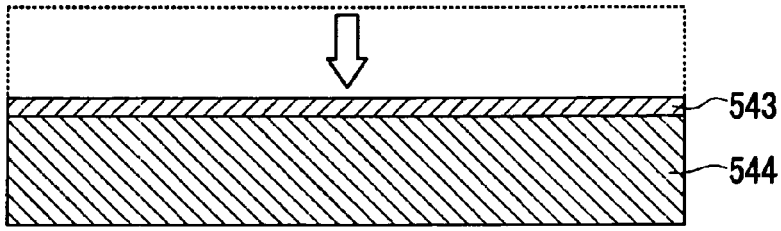
FIG.11B Prior Art
Figure 11C:
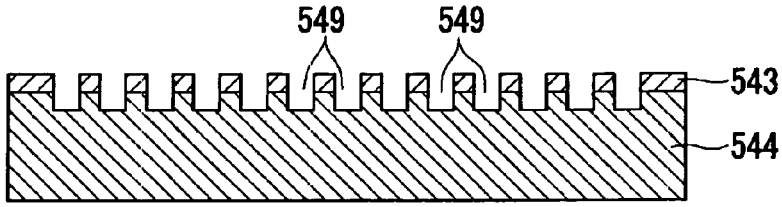
FIG.11C Prior Art
Figure 11D:
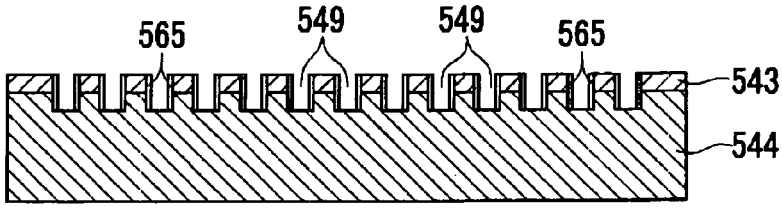
FIG.11D Prior Art
Figure 11E:
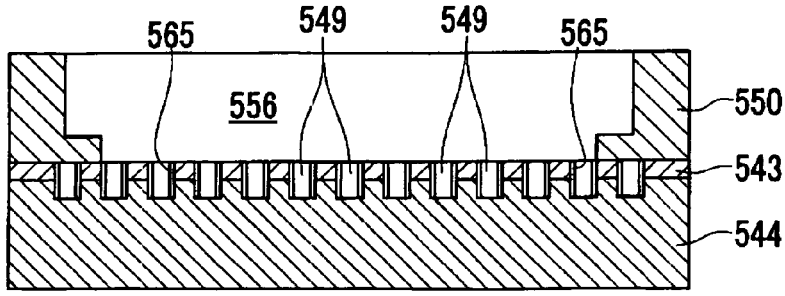
FIG.11E Prior Art

FIG. 10 is a sectional view showing an inkjet head 126 provided in an inkjet recording apparatus according to the second embodiment, which corresponds to FIG. 5B referenced in the first embodiment.

Note that constitutional elements common to the first embodiment are denoted by the same symbols in FIG. 10, and detailed descriptions thereof are omitted.

As shown in FIG. 10, in the inkjet head 126 according to this embodiment, drive electrodes 161 are formed only on side wall surfaces of the first groove portions 46 among the first groove portions 46 and the second groove portions 48 which form the ink chamber 49. Besides, the polarization direction 43*z* of the first piezoelectric substrate 43 is the same as the polarization direction 44*z* of the second piezoelectric substrate 44 in a substrate thickness direction.

In the inkjet head 126 according to this embodiment, the drive electrodes 161 are formed only on a part of the side wall surfaces of the ink chambers 49. When voltage is applied to those drive electrodes 161 and an electric field is made to act on the side walls 45, the inkjet head 126 can be operated as in the case of the first embodiment.

However, the shear deformation is generated owing to the electric field only on the side walls 45, and thus the drive voltage needs to be larger compared with the first embodiment.

In the case where the drive electrode is formed only in a part of the ink chamber 49, in order to obtain a large amount of deformation, the drive electrodes need to be accurately formed in a half region of side surfaces of the ink chamber 49 in a height direction thereof. In this regard, conventionally, a groove portion having a depth corresponding to a height of the ink chamber is formed in the piezoelectric substrate, and oblique vapor deposition in which an angle thereof is adjusted is performed on the groove portion, to thereby form the drive electrode. In such a formation method, forming regions of the drive electrodes differ from each other depending on a positional relationship between a vapor deposition source and the groove portion, which makes it difficult to accurately form a metal film only in a part of the side wall.

When the structure according to this embodiment is adopted, the drive electrodes 161 are formed in advance in the first groove portion 46 of the first piezoelectric substrate 43, and thus the forming region of the drive electrode 161 is accurately defined by merely aligning a processing depth of the first groove portion 46 and a processing depth of the second groove portion 46. Hence, this embodiment has a structure which can contribute to improvements of the performance and yield of the inkjet head including drive electrodes only in a part of the side walls of the ink chamber.

Note that this embodiment has the structure in which the drive electrodes 161 are formed only on the side wall surfaces of the first groove portion 46, but may have the structure in which the drive electrodes 161 are formed only on the side wall surfaces of the second groove portion 48 of the second piezoelectric substrate 44. Also in this case, similar operation and effect can be obtained. Further, the polarization directions 43*z* and 44*z* are the same direction in this embodiment, but may be opposite to each other as in the first embodiment. This is because the shear deformation does not occur in the side walls where the drive electrodes are not formed.

Further, the structure in which two piezoelectric substrates are provided is described in this embodiment. However, the inkjet head 126 according to this embodiment requires that only the first piezoelectric substrate 43 be a piezoelectric substrate, and a substrate made of other material can be used in place of the second piezoelectric substrate 44. For instance, in place of the second piezoelectric substrate 44, a ceramic substrate such as an alumina substrate can be used. This is because, in the structure where the drive electrodes 161 are formed only in the first groove portion 46 as in this embodiment, only the side wall 45 is deformed owing to the electric field, and the side wall 47 merely deforms following the side wall 45. In addition, the alumina substrate or the like available at a few tenths of the cost for the piezoelectric substrate is used in place of the piezoelectric substrate, with the result that costs can be greatly reduced.

It goes without saying that there can be employed a structure where the ceramic substrate is used in place of the first piezoelectric substrate 43, and the drive electrodes are formed in the second groove portion 48 of the second piezoelectric substrate 44. If the ceramic substrate is used in place of the first piezoelectric substrate 43 whose processing amount is increased because of the formation of the ink supply path 56, an amount of the piezoelectric material discarded through processing is reduced. Accordingly, waste of the material can be reduced.

What is claimed is:

1. An inkjet head comprising:

a base substrate;

a plurality of ink chambers formed in the base substrate; and a plurality of drive electrodes formed on side walls of the plurality of ink chambers;

wherein the base substrate comprises a first piezoelectric substrate and a second piezoelectric substrate bonded to the first piezoelectric substrate, the first and second piezoelectric substrates having opposite polarization directions in respective thickness directions thereof;

wherein the first piezoelectric substrate comprises a plurality of first groove portions formed on one surface of the first piezoelectric substrate, and an ink supply path connected to the plurality of first groove portions and opening toward another surface of the first piezoelectric substrate;

wherein the second piezoelectric substrate comprises a plurality of second groove portions which jointly with the plurality of first groove portions of the first piezoelectric substrate form the plurality of ink chambers; and wherein the plurality of drive electrodes comprise first drive electrodes formed on sidewalls of the first groove portions, second drive electrodes formed on sidewalls of the second groove portions, and a plurality of conduction members formed only adjacent to the ink supply path and electrically connecting the respective first and second drive electrodes to one another.

2. An inkjet head according to claim 1; wherein a width of each of the second groove portions is smaller than a width of each of the first groove portions.

3. An inkjet head according to claim 1; wherein a width of each of the second groove portions is different than a width of each of the first groove portions.

4. An inkjet head according to claim 1; wherein each of the first groove portions has a depth substantially equal to a depth of the second groove portions.

5. An inkjet recording apparatus comprising the inkjet head according to claim 1.

6. A method for manufacturing an inkjet head, comprising the steps of:

preparing a first substrate by providing a first piezoelectric substrate having a first polarization direction in a thickness direction of the first piezoelectric substrate, forming a plurality of first groove portions on one surface of the first piezoelectric substrate, forming an ink supply path connected to the plurality of first groove portions and opening toward another surface of the first piezoelectric substrate, and forming first drive electrodes on sidewalls of the first groove portions;

preparing a second substrate by providing a second piezoelectric substrate having a second polarization direction in a thickness direction of the second piezoelectric substrate and different from the first polarization direction, forming a plurality of second groove portions on a surface of the second piezoelectric substrate, and forming second drive electrodes on sidewalls of the second groove portions;

bonding the first and second substrates to one another in a state in which the first groove portions are aligned with the respective second groove portions so that the aligned first and second groove portions form respective ink chambers; and forming only adjacent to the ink supply path a plurality of conductive members that electrically connect the respective first and second drive electrodes to one another.

7. A method according to claim 6; wherein the steps of forming the first and second groove portions comprise forming each of the first groove portions with a depth different from a depth of the second groove portions.

8. A method according to claim 6; wherein the steps of forming the first and second groove portions comprise forming each of the first groove portions with a depth substantially equal to a depth of the second groove portions.

9. A method according to claim 6; wherein the steps of forming the first and second groove portions comprise forming the second groove portions with a width smaller than a width of the first groove portions.

10. A method according to claim 6; wherein the step of forming the conductive members comprises the step of vapordepositing a metal film from the ink supply path of the first substrate toward the ink chambers.

11. A method according to claim 6; wherein the step of forming the conductive members comprises forming the conductive members on side walls of the ink chambers.

12. An inkjet head comprising:

a first substrate having first groove portions formed on one surface of the first substrate and an ink supply path connected to the first groove portions and opening toward another surface of the first substrate;

a second substrate having second groove portions and being connected to the first substrate so that the first and second groove portions jointly form a plurality of ink chambers; and first drive electrodes formed on sidewalls of the first groove portions;

second drive electrodes formed on sidewalls of the second groove portions; and a plurality of conduction members formed only adjacent to the ink supply path of the first substrate and electrically connecting the respective first and second drive electrodes to one another.

13. An inkjet head according to claim 12; wherein the first and second substrates comprise piezoelectric substrates having opposite polarization directions in respective thickness directions thereof.

14. An inkjet head according to claim 12;

wherein a width of each of the second groove portions is smaller than a width of each of the first groove portions.

15. An inkjet head according to claim 12; wherein a width of each of the second groove portions is different than a width of each of the first groove portions.

16. An inkjet head according to claim 12; wherein each of the first groove portions has a depth substantially equal to a depth of the second groove portions.

17. An inkjet recording apparatus comprising the inkjet head according to claim 12.

* * * * *